United States Patent [19]

Nestor et al.

[11] Patent Number: 4,679,885

[45] Date of Patent: Jul. 14, 1987

[54] ELECTRICAL COMPONENT PACKAGING ASSEMBLY

[75] Inventors: Charles R. Nestor, Niles; Raymond A. Maga, Poland; Gregory L. Bensing, Cortland, all of Ohio

[73] Assignee: General Motors Corporation, Detroit, Mich.

[21] Appl. No.: 891,994

[22] Filed: Aug. 1, 1986

[51] Int. Cl.[4] ..... H01R 13/42; H01R 13/66

[52] U.S. Cl. ..... 439/620; 439/752

[58] Field of Search ..... 339/147 R, 147 P, 217 R

[56] References Cited

U.S. PATENT DOCUMENTS

| | | | |
|---|---|---|---|
| 4,018,981 | 4/1977 | Hawkins | 339/147 R |
| 4,113,341 | 9/1978 | Hughes | 339/147 R |
| 4,239,319 | 12/1980 | Gladd et al. | 339/166 R |
| 4,375,311 | 3/1983 | Feldman | 339/147 R |
| 4,386,818 | 6/1983 | Millhimes et al. | 339/113 L |
| 4,580,001 | 4/1986 | Hikami | 339/147 R |

*Primary Examiner*—Gil Weidenfeld
*Assistant Examiner*—Gary F. Paumen
*Attorney, Agent, or Firm*—Patrick M. Griffin

[57] ABSTRACT

An electrical component packaging assembly in which the same structure and operation that makes electrical contact between a pair of terminals and a pair of leads of the component also serves to simultaneously mechanically lock the terminals to the assembly. The component leads are fitted within aligned slots in the terminals and in a housing to lock the terminals against withdrawal from the housing.

3 Claims, 3 Drawing Figures

ELECTRICAL COMPONENT PACKAGING ASSEMBLY

This invention relates to package assemblies for electrical components in general, and specifically to such a package assembly for a component that has leads, and which makes electrical connection between the component leads and a pair of terminals in such a way so as to simultaneously mechanically lock the terminals to the package assembly.

BACKGROUND OF THE INVENTION

It is often desirable for ease of handling and protection from the environment to package electrical components, such as diodes or resistors, in an assembly that houses the component, as well as making electrical connection with it. In such a package assembly, an insulating housing contains the component and also contains terminals to make electrical contact with leads of the component, and it is necessary to somehow retain those terminals in the housing. The U.S. patents show several examples of such package assemblies. The U.S. Pat. No. 4,018,981 to Hawkins, assigned to the assignee of the present invention, discloses a package assembly with an insulating housing 12 that receives an electrical component 36. The housing 12 also includes passages that receive a pair of terminals 52, which make electrical contact with the component 36. The terminals 52 are mechanically locked into the housing 12 by projections 82 on a cover 16 hinged to part of the housing 12. When the cover is snapped into place, the projections 82 block the terminals 52 from being withdrawn. The U.S. Pat. No. 4,580,001 to Hikami shows a package device with an insulating body 1 having a cavity 3 that receives the body 4 of a component that has a pair of leads 8 extending out to the sides. After the component is in place, a pair of terminals 9 are pushed down into parallel grooves 2 on either side of the cavity 3 to make contact with the leads 8. In a separate operation, the terminals 9 are then bowed down so that tabs 13 thereon may be resiliently inserted into undercuts 5 in the grooves 2. A great drawback to this structure is that the package has to be disassembled, by taking the terminals 9 out, before the component can be removed. This is a great disadvantage if the component is one that may frequently need to be changed, like a diode in a current suppression device.

SUMMARY OF THE INVENTION

The invention provides a package assembly of the type generally described above that includes an improved means for mechanically locking the terminals to the package assembly.

The invention is designed to be used with an electrical component having a lead, which, as disclosed is a diode having a generally cylindrical body with a pair of wire leads extending out from each end thereof. The package assembly includes an insulating housing and a pair of terminals. The housing has a cavity within which the body of the component is receivable, a cavity that is bordered by a pair of spaced apart housing walls. The housing walls provide the outer walls of a pair of passages, one on either side of the cavity, within which the terminals are receivable. Each of the housing walls has a first slot with an open end therein that is generally orthogonal to a respective terminal receiving passage, and which is sized so that a component lead may be closely fitted therewithin.

Each of the terminals has a flange that rests generally adjacent to a respective housing wall when the terminals are received within the passages. Each terminal flange has a second slot with an open end that is sized similarly to the first slot and which is generally aligned with a respective first slot when the terminals are so received. Therefore, when the component body is received in the cavity, each of the component leads may be fitted within a respective pair of aligned first and second slots, which makes electrical contact between the component leads and the terminals. By virtue of the generally orthogonal orientation of the pairs of aligned slots and the terminal passages, the terminals are simultaneously mechanically locked against withdrawal from the passages. The same operation and structure that make the electrical contact cooperates to mechanically lock the terminals to the package assembly. The fact that the component is added last allows it to be removed for replacement without removing the terminals or otherwise disassembling the package. In addition, in the embodiment disclosed, the package assembly includes a cavity cover which can be added after the component is received to further protect the component, and to assure that it is properly seated within the cavity.

It is, therefore, a broad object of the invention to provide a package assembly for packaging an electrical component that makes electrical connection between the component lead and a terminal in such a way so as to cooperatively mechanically lock the terminal to the package assembly.

It is another object of the invention to provide such a package assembly in which a housing having a cavity within which the component is receivable has a pair of spaced walls located outboard of the cavity, the walls providing the outer walls of a pair of terminal receiving passages, and with each of the spaced walls also having a first slot therein generally orthogonal to a respective passage and sized so that a terminal lead may be closely fitted therewithin, and in which each of a pair of terminals has a second slot sized so that a terminal lead may also be closely fitted therewithin and located so as to generally align with a respective first slot when the terminals are received in the passages, whereby, after the terminals have been so received, the component may then be received in the cavity and the component leads closely fitted within the aligned first and second slots, thereby electrically connecting the component leads to the terminals and simultaneously mechanically locking the terminals against withdrawal from the passages.

DESCRIPTION OF THE PREFERRED EMBODIMENT

These and other objects and features of the invention will appear from the following written description and the drawings, in which.

Figure 1:
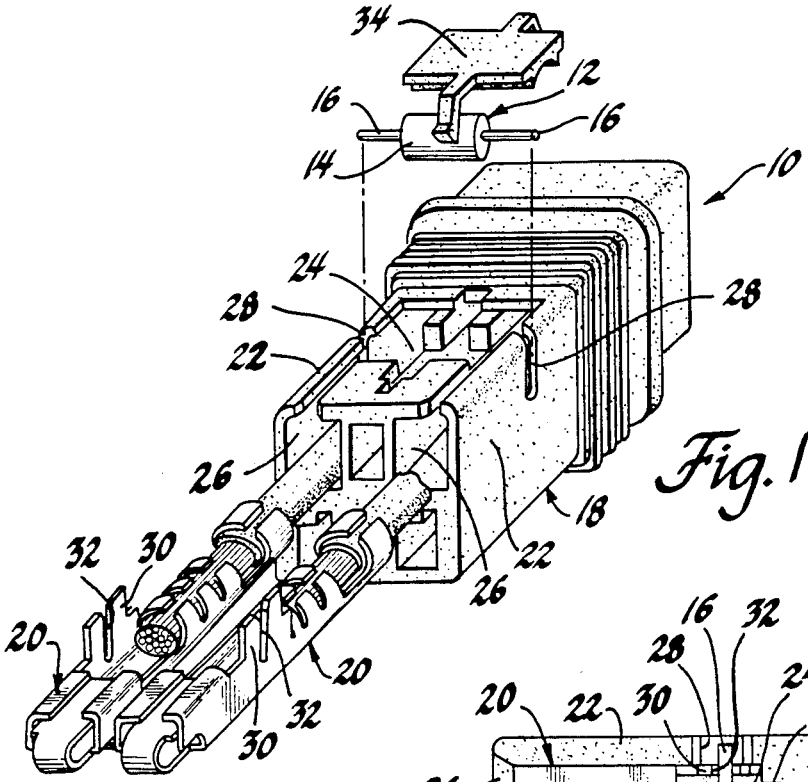
FIG. 1 is an exploded perspective view of an electrical component and of the various parts of the package assembly of the invention.

Referring first to FIG. 1, a preferred embodiment of the package assembly of the invention is designated generally at 10. The invention is designed to be used with an electrical component, designated generally at 12, which may be any component desired, but which, as disclosed, is a diode. The invention as disclosed provides a current suppression device for the circuitry of a vehicle or the like. The diode 12 is the type that has a cylindrical body 14 and a pair of wire leads 16 extending more or less straight out from the ends thereof. The leads 16, which are wire, are the means by which electrical contact is made with the diode 12, but, in the invention, they are also used to provide an additional advantage, as will appear below. The basic structure of the the package assembly 10 that contains and handles the diode 12 includes an insulating housing designated generally at 18 and a pair of terminals, each designated generally at 20. The housing 18 is molded of any suitable insulating material, and is generally box shaped with a pair of spaced side walls 22. The side walls 22 are located outboard of a central cavity 24 within which the diode body 14 is receivable by a downward push, as shown by the dotted lines in FIG. 1. Each side wall 22 of the housing 18 also provides the outer wall of one of a pair of generally parallel terminal receiving passages 26. The passages 26 are located one on either side of the cavity 24 and are open to the cavity 24 on their inner sides, and also open through the front end of housing 18. The terminals 20 may, therefore, be received in the housing 18 by pushing or pulling them into the passages 26. The terminals 20 are shown in FIG. 1 before being seated into the passages 26. Each of the housing side walls 22 also has a first slot 28 with an open upper end that is generally orthogonal to a respective terminal passage 26, and which is sized so that a component lead 16 may be closely fitted therewithin.

Figure 2:
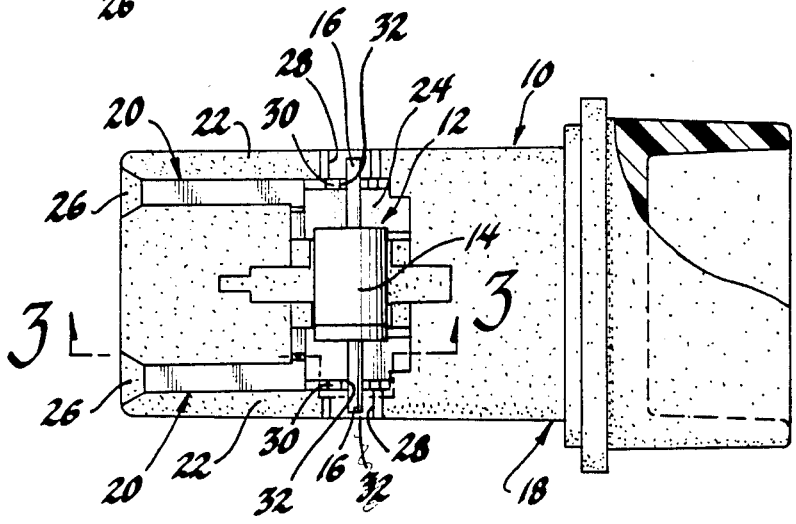
FIG. 2 is a top plan view of the package assembly of the invention, but with the component installed and the cover removed.
Figure 3:
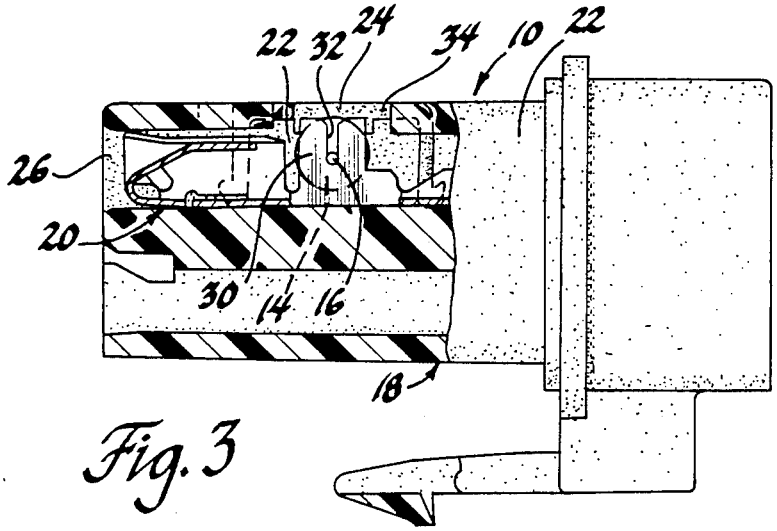
FIG. 3 is a side view of the package assembly of the invention with part of the housing broken away to reveal details.

Referring next to FIGS. 1 through 3, each of the terminals 20, which are formed of any suitable conductive material, also has a generally rectangular and flat upstanding flange 30, best seen in FIG. 1. Each terminal flange 30 has a second slot 32 with an open upper end similar to the first slots 28. However, each second slot 32 is narrower than a corresponding first slot 28, so that a lead 16 fits more closely, in fact tightly, therewithin. After the terminals 20 are seated in their passages 26, as they are shown in FIGS. 2 and 3, each flange 30 rests generally adjacent to a respective housing side wall 22. The first and second slots 28 and 32 are, at that point, generally aligned in pairs, as best seen in FIG. 3. Therefore, when the diode body 14 is installed in the cavity 24 as described above, each of the wire leads 16 may be fitted within a respective pair of first and second slots 28 and 32 at the same time. The leads 16 are long enough to extend through both slots 28 and 32 of each pair, and, in fact, excess may have to be trimmed. Because of the tightness of fit described above, the leads 16 may have to be seated with a pushing tool that pushes directly on each lead 16, rather than by just pushing down on the diode body 14 itself. The tight fit of the wire leads 16 in the terminal flange slots 32 makes electrical contact between the diode 12 and the terminals 20. Any other circuit element desired may in turn be plugged into the terminals 20. Furthermore, by virtue of the generally orthogonal orientation of the pairs of aligned slots 28 and 32 relative to leads 16, a push or pull on the terminals 20 will engage the ends of the wire leads 16 with an edge of the housing side wall slots 28. The terminals, therefore, will be mechanically locked against being withdrawn, by pushing or by pulling, from the passages 26. The fit of the leads 16 within the housing side wall slots 28 is not as close as the tight fit within the terminal flange slots 32, but is sufficiently close to substantially confine the terminals 20 within the passages 26. Thus, the single operation of installing the diode 12 by pushing it down into the cavity 24 in one direction makes electrical connection and simultaneously cooperates to mechanically lock the terminals 20 to the package assembly 10, using the same structure. Another advantage is that, by installing the diode after the terminals are put in place, the diode 12 may be easily removed from the open ended aligned slots 28 and 32 for replacement, without disturbing the terminals 20 or otherwise disassembling the package assembly 10. In the preferred embodiment disclosed, a cavity cover 34 is also provided, which is snap fitted to the housing 18 after the diode 12 has been installed, to further protect the diode 12. The undersurface of the cover 34 will engage the diode body 14 and help assure that it is properly seated within the cavity 24.

Variations of the preferred embodiment 10 may be made within the spirit of the invention. For example, more or fewer electrical components like diode 12, with more or fewer leads 16, may be used, and with consequently more or fewer pairs of aligned slots 28–32 within which the component leads 16 are fitted. So long as the substantially orthogonal relation of the aligned slots 28–32 and the terminal passages 26 exists, the terminals 20 will be mechanically locked against displacement into or out of the terminal passages 26. Clearly, if the orientation of the aligned slot pairs 28–32 were made more nearly colinear with the terminal passages 26, the terminals 20 would then be less positively locked against displacement in whichever direction which would tend to slide the component lead 16 out of the open end of the terminal slot 32. Therefore, it will be understood that the invention is not intended to be limited to the exact embodiment disclosed.

The embodiments of the invention in which an exclusive property or privilege is claimed are defined as follows:

1. A package assembly for packaging an electrical component having a lead and for electrically connecting said component lead to a terminal so as to cooperatively mechanically lock said terminal to said package assembly, comprising, a housing having a cavity for receiving said component and a first slot sized so that said component lead may be closely fitted therewithin, said housing also having a terminal receiving passage adjacent and generally orthogonal to said first slot, and, a terminal having a second slot sized so that said component lead may be closely fitted therewithin and located so as to generally align with said first slot when said terminal is received in said passage, whereby, after said terminal has been so received, said component may then be received in said cavity and said component lead closely fitted within said first and second aligned slots, thereby electrically connecting said component lead to said terminal and simultaneously mechanically locking said terminal against withdrawal from said passage.

2. In a package assembly for packaging an electrical component having a pair of leads, said package assembly including a housing having a cavity for receiving said component and a pair of terminals received in a pair of passages of said housing for making electrical connection to said component leads, the improvement comprising, a pair of spaced walls on said housing located outboard of said cavity, said walls providing the outer walls of said terminal receiving passages, with each of said spaced walls also having a first slot therein generally orthogonal to a respective passage and sized so that said component lead may be closely fitted therewithin, and, a flange on each of said terminals, each said flange having a second slot therein sized so that said component lead may be closely fitted therewithin, each of said flanges further being located so as to generally align said second slot with a respective first slot when said terminals are received in said passages, whereby, after said terminals have been so received, said component may then be received in said cavity and said component leads closely fitted within said aligned first and second slots, thereby electrically connecting said component leads to said terminals and simultaneously mechanically locking said terminals against withdrawal from said passages.

3. A package assembly for packaging an electrical component having a pair of leads and for electrically connecting said component leads to a pair of terminals so as to cooperatively mechanically lock said terminals to said package assembly, comprising, a housing having a cavity within which said component is receivable and a pair of spaced walls located outboard of said cavity, said walls providing the outer walls of a pair of terminal receiving passages, with each of said spaced walls also having a first slot therein generally orthogonal to a respective passage and sized so that said component lead may be closely fitted therewithin, a pair of terminals, each having a second slot sized so that said component lead may be closely fitted therewithin and located so as to generally align with a respective first slot when said terminals are received in said passages, whereby, after said terminals have been so received, said component may then be received in said cavity and said component leads closely fitted within said aligned first and second slots, thereby electrically connecting said component leads to said terminals and simultaneously mechanically locking said terminals against withdrawal from said passages.

* * * * *